United States Patent [19]

Lashman

[11] Patent Number: 4,773,644

[45] Date of Patent: Sep. 27, 1988

[54] BOWLER'S APPROACH GUIDE

[76] Inventor: Steven L. Lashman, 1010 North Murray, Colorado Springs, Colo. 80915

[21] Appl. No.: 55,376

[22] Filed: May 29, 1987

[51] Int. Cl.[4] ..... A63B 69/00

[52] U.S. Cl. ..... 273/54 D; 273/50; 273/DIG. 30; 434/249

[58] Field of Search ..... 273/50, 54 R, 54 D, 273/DIG. 30; 5/417, 420; 434/247, 248, 249, 250, 251, 252

[56] References Cited

U.S. PATENT DOCUMENTS

| | | | |
|---|---|---|---|
| 233,482 | 10/1880 | De Long | 434/250 X |
| 1,621,511 | 3/1927 | Kempien | 273/50 |
| 1,815,443 | 7/1931 | Mitchell | 434/250 |
| 2,375,663 | 5/1945 | Kennedy | 273/51 |
| 2,976,914 | 3/1961 | Miller | 5/420 X |
| 2,994,968 | 8/1961 | Phillips | 273/54 D X |
| 3,021,616 | 2/1962 | Abrams | 434/249 |
| 3,081,559 | 3/1963 | Kaminsky | 434/249 |
| 3,210,079 | 10/1965 | Tryon | 273/54 D |
| 3,250,535 | 5/1966 | Patterson et al. | 273/54 D |
| 3,317,208 | 5/1967 | Birkic | 273/54 D |
| 3,979,116 | 9/1976 | Matchick | 434/247 X |
| 4,204,705 | 5/1980 | Gordon et al. | 283/1 R |
| 4,382,306 | 5/1983 | Lickert | 5/465 |

*Primary Examiner*—Anton O. Oechsle
*Attorney, Agent, or Firm*—Klaas & Law

[57] ABSTRACT

A bowler's approach guide comprising an elongated relatively thin, flat sheet of material having sufficient strength so that a bowler may walk repeatedly thereover but flexible enough to be folded and placed into a compact package which can be readily carried from one location to a distant location is provided. The thin, flat sheet has a length and width corresponding to the length and width of a conventional approach area for a bowling alley and has imprinted on the upper surface thereof a duplication of the boards, guide markers and foul line of the conventional approach area. Also, a spot dart marks guide comprising a thin, flat sheet having imprinted on an upper surface thereof spot dart marks is provided.

16 Claims, 1 Drawing Sheet

FIG. 2.
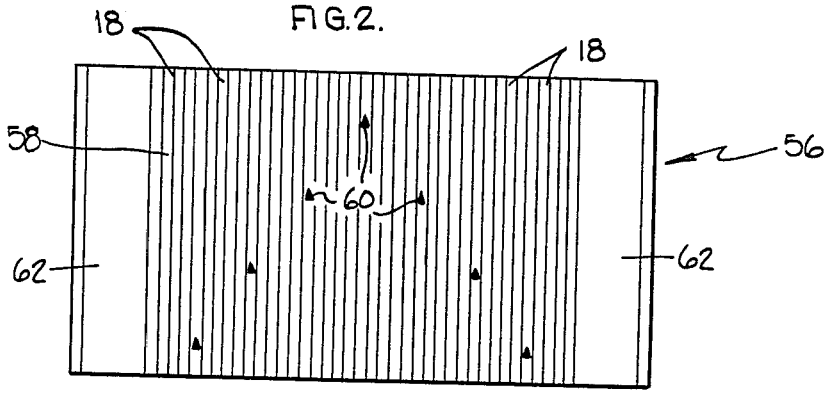
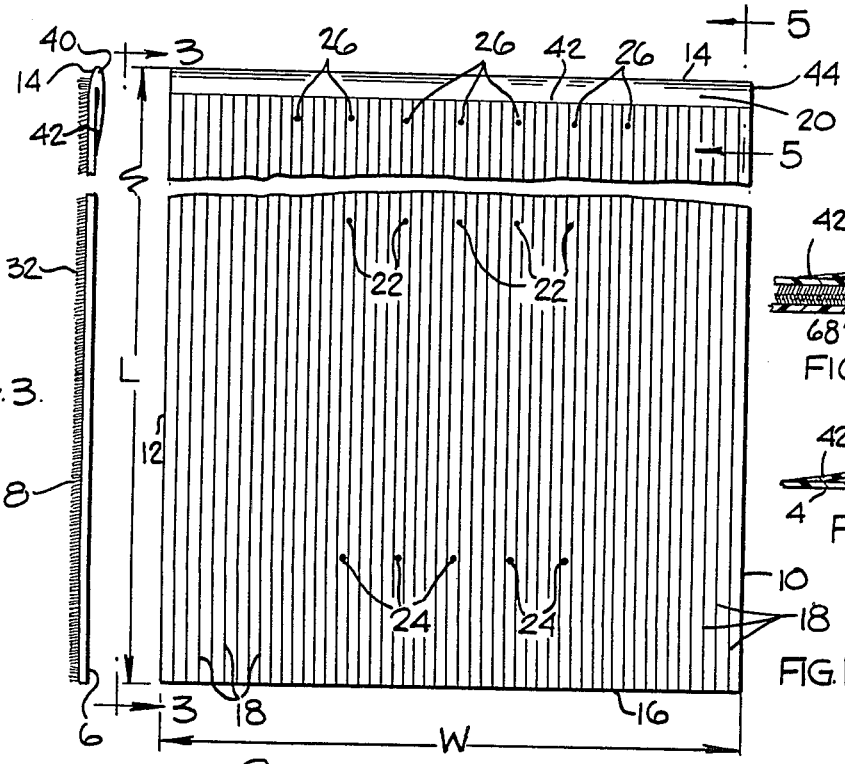
FIG. 3.
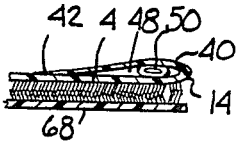
FIG. 5
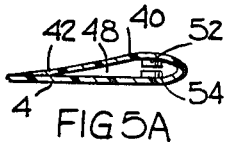
FIG 5A
FIG. 1
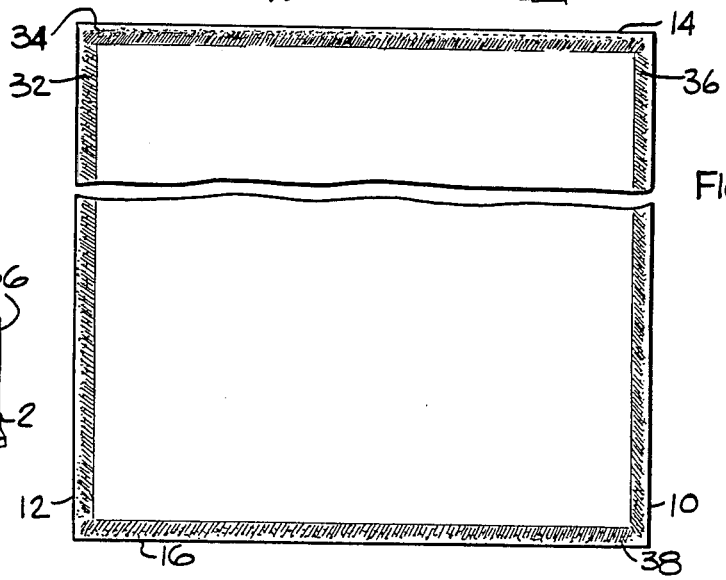
FIG. 4
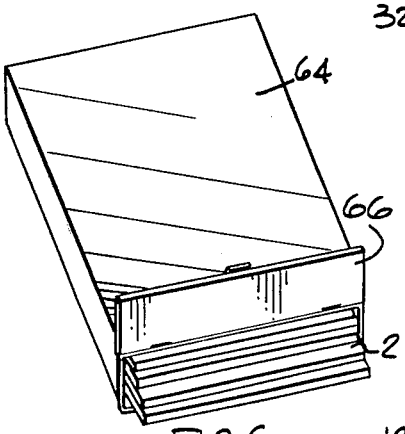
FIG. 6.

BOWLER'S APPROACH GUIDE

FIELD OF THE INVENTION

This invention is directed generally to the sport of bowling and more particularly to the field of teaching and practicing devices for aiding the development of proper bowling techniques and which can be readily carried by the bowler for use on any surface at any location.

BACKGROUND OF THE INVENTION

There have been many devices made for use in teaching and practicing the techniques required for attaining success in bowling. Some of these devices are rather large and are adapted to be used in conjunction with a standard bowling alley. Other devices have been suggested for use in basements but these are large and of rugged construction and cannot be readily moved or carried from one location to another location. Other types of devices include instruments or markings for indicating to a bowler the proper locations over which a bowling ball should move in order to knock down the pins. In the field of dancing, there have been instructional devices for illustrating the proper positioning of the feet for accomplishing a desired dance. There have been games, such as checkers and hopscotch, imprinted on plastic sheets for use where desired. There are numerous golfing aids for positioning on surfaces for practicing different techniques such as putting. However, applicant is not aware of any good teaching and practicing device for aiding the development of proper bowling techniques that is readily understandable and easy to use and which may also be folded into a compact package so that it may be readily carried from one location to a distant location and used on any surface as desired.

BRIEF DESCRIPTION OF THE INVENTION

This invention provides a teaching and practicing device for aiding in the development of proper bowling techniques comprising an elongated relatively thin, flat sheet of material having imprinted on the upper surface thereof a duplication of the boards, markers and foul line of a standard approach area of a conventional bowling alley. The material in the thin, flat sheet has sufficient strength to withstand repeated walking thereover by a bowler but also is flexible enough so that it may be folded and placed into a carrier to form a compact package and readily carried by the bowler from one location to any other desired location.

In the preferred embodiment of the invention, the elongated relatively thin, flat sheet has a length and a width corresponding to the length and width of an approach area of a conventional bowling alley. The material in the thin, flat sheet is plastic, such as a polyvinyl chloride having a thickness greater than about 4 mils, but may be made from other plastic materials having structural characteristics for the above-described use. The thin, flat sheet has imprinted on its upper surface parallel lines to simulate the boards of a standard approach area in a bowling alley. Also, imprinted on the upper surface are the conventional first and second lines of start position marks and a foul line extending transversely of the thin, flat sheet. Holding means are provided so that the thin, flat sheet may be positioned on a surface and held in place so that the bowler may move over the thin, flat sheet and practice his bowling approach. In one embodiment of the invention, the holding means comprises one half of a hook and loop fastener secured to the lower surface of the thin, flat sheet adjacent to at least two longitudinally extending side edge portions thereof so that if the thin, flat sheet is laid on a carpeted surface, it will be held in position. Also, the thin, flat sheet may be positioned in front of a mirror so that the bowler can observe his practice. Also, indicating means are associated with the foul line so as to give a positive signal if the bowler encroaches the foul line during his practice. Another thin, flat sheet having imprinted thereon a conventional series of spot dart markers may be provided for positioning at a proper location relative to the approach guide thin, flat sheet.

BRIEF DESCRIPTION OF THE DRAWING

An illustrative and presently preferred embodiment of the invention is shown in the accompanying drawing in which:

FIG. 1 is a top plan view of a portion of the bowler's approach guide of this invention;

FIG. 2 is a top plan view of spot dart marks guide for use with the bowler's approach guide;

FIG. 3 is a side elevational view of FIG. 1 looking from the line 3—3;

FIG. 4 is a partial bottom plan view illustrating the holding means;

FIG. 5 is a cross-sectional view taken on the line 5—5 of FIG. 1;

FIG. 5A is a cross-sectional view of a portion of a modification of FIG. 5; and FIG. 6 is a pictorial view illustrating a folded bowler's approach guide being inserted into a carrier to form a compact package.

DETAILED DESCRIPTION OF THE INVENTION

A bowler's approach guide 2 is illustrated in FIG. 1 and comprises an elongated relatively thin, flat sheet 4 of material, preferably a plastic material as described above, having a length L and a width W. In FIG. 1, a portion of the bowler's approach guide 2 is broken away but it is understood that the bowler's approach guide 2 will have a length L and a width W which are the same as the length and width of a standard approach area of a conventional bowling alley. The thin, flat sheet 4 has an upper surface 6, a lower surface 8, a pair of parallel lengthwise extending side edge portions 10 and 12, a front edge portion 14 and a back edge portion 16. A plurality of lengthwise extending lines 18 are imprinted on the upper surface 6 to simulate the board lines in a standard approach area. A foul line 20 extends transversely across the thin, flat sheet 4 adjacent to the front edge portion 14. A first plurality of circular marks 22 are imprinted on the upper surface 6 to designate the location of the first start position. A second plurality of circular marks 24 are imprinted on the upper surface 6 to designate the location of the second start position. A third plurality of circular marks 26 are imprinted on the upper surface 6 to designate the location of the delivery position. The first, second and third plurality of circular marks 22, 24 and 26 correspond to the circular marks on a standard approach area.

The holding means 30 is illustrated in FIGS. 3 and 4 and comprises strips 32, 34, 36 and 38 of one half of a hook and loop fastening material secured to the lower surface 8 of the thin, flat sheet 4 adjacent to the side edge portions 10 and 12, the front edge portion 14 and the back edge portion 16. The thickness of the hook and loop fastener has been exaggerated for illustration purposes. In some instances, only the strips 32 and 36 along the side edge portions 10 and 12 are used. The strips 32, 34, 36 and 38 are secured to the lower surface 8 so that the hook and loop fastening material is exposed. As described below, when the bowler's approach guide 2 is positioned on a carpeted floor, the hook and loop fastening material will cooperate with the carpet to hold the bowler's approach guide 2 in position so that it can be used by the bowler.

The structure forming the foul line 20 is illustrated in FIG. 5 and comprises an end portion 40 of the thin, flat sheet 4 which is folded back on itself and the transversely extending edge portion 42 thereof is heat sealed to the upper surface 6 of the thin, flat sheet 4. The side edge portions 44 and 46 of the end portion 40 are also heat sealed to the upper surface 6 adjacent to the side edge portions 10 and 12 so as to form an air pocket 48 therebetween. A plurality of mechanical squeaking means 50 are mounted within the air pocket 48 so as to emit an audible squeaking sound if the bowler encroaches the foul line 20. In the alternative as illustrated in FIG. 5A, spaced apart electrical contacts 52 and 54 connected to a source of electrical power (not shown) are mounted within the air pocket 48 to generate an electrical signal when moved into contact by the encroachment of the bowler on the foul line 20.

In FIG. 2, there is illustrated a spot dart marks guide 56 which may be used with the bowler's approach guide 2. The spot dart marks guide 56 is preferably a separate unit but could be made integral with the bowler's approach guide 2. The spot dart marks guide 56 is a relatively thin, flat sheet 58 of a material, preferably a plastic, having imprinted on the upper surface thereof the spot dart marks 60 corresponding to those on a standard bowling alley. Since the spot dart marks guide 56 will not be walked on, it can be formed from a lighter plastic material than the plastic material used for the bowler's approach guide 2. The spot dart marks guide 56 has lines 18 simulating the board lines of a standard bowling alley and simulated gutters 62 of a standard bowling alley. The spot dart marks guide 56 is provided with hook and loop fastening material in a manner similar to that of the bowler's approach guide 2.

The packaging of the bowler's approach guide 2 is illustrated in FIG. 6 wherein a bowler's approach guide 2 has been folded upon itself several times and is being inserted into an opened carrier 64 which is provided with a closing flap 66. The spot dart marks guide 56 may be similarly folded and placed into the carrier 64 to form a compact package.

The bowler's approach guide may be used on any surface at any location so that bowlers may practice the proper approach for improving their bowling techniques. For example, the bowler's approach guide 2 may be carried on a trip and removed from the carrier 64 in a hotel room. The bowler's approach guide 2 is unfolded and laid on the floor with the hook and loop fasteners 32, 34, 36 and 38 in contact with the carpet in the floor to hold the bowler's approach guide 2 in place. Preferably, the bowler's approach guide 2 is laid on the floor with the foul line 20 in front of a mirror so that the bowler may observe his or her approach. The bowler's approach guide 2 may also be used at home on a hard surface area such as a basement or recreation room floor. A plurality of strips 68 of one half of a hook and loop fastening material are secured to the floor with the hook and loop fastening material facing upwardly and the strips are positioned so,as to mate with the strips 32, 34, 36 and 38 of the hook and loop fastening material on the bowler's approach guide 2. Similar strips of a "VELCRO" fastening material are used to position the spot dart marks guide 56 at the proper distance in front of the foul line 20. A mirror may then be positioned in front of the spot dart marks guide 56 so that a bowler using the bowler's approach guide 2 and the spot dart marks guide 56 may observe his or her approach. The bowler preferably has stockings on his or her feet when using the bowler's approach guide 2. In most instances, a bowler will not use a ball when using the bowler's approach guide 2. In addition to its use by an experienced bowler, the bowler's approach guide 2 is an excellent device for teaching new bowlers such as children. Another use for a bowler's approach guide is for an experienced bowler who may wish to change the number of steps that he or she uses when bowling, such as changing from a three step to a five step approach.

Hook and loop fasteners sold under the trademark "VELCRO" are representative of the fasteners which may be employed as the hook and loop fasteners described above.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A bowlers's approach guide for use on a surface at any desired location for practicing a bowler's approach the foul line of a conventional bowling alley without actual delivery of a bowling ball comprising:

a first elongated relatively thin, flat sheet of material having a rectangular configuration corresponding to the standard approach area used at a conventional bowling alley formed from a relatively light weight flexible plastic material;

said elongated thin, flat sheet having longitudinal extending parallel lines imprinted thereon to simulate the boards forming said standard approach area;

first and second lines of start position marks imprinted on said elongated relatively thin, flat sheet, each of said first and second lines comprising a plurality of spaced apart circular marks located at positions corresponding to similar circular marks used on said standard approach area;

a foul line indicator extending transversely across said elongated relatively thin, flat sheet to simulate the conventional foul line on said standard approach area;

holding means for holding said elongated relatively thin, flat sheet at a fixed position on said surface so that a bowler may walk over said elongated relatively thin, flat surface and practice his or her bowling approach;

a separate second elongated relativeIy thin, flat sheet having a rectangular configuration corresponding to the first part of the bowling alley next adjacent to said foul line indicator formed from a relatively light weight flexible plastic material;

said separate second elongated relatively thin, flat sheet having longitudinally extending parallel lines imprinted thereon to simulate the boards forming the first part of a bowling alley and having a series of spot dart marks imprinted thereon corresponding to the spot dart marks on a standard bowling alley; and holding means for permitting said separate second elongated relatively thin, flat sheet to be positioned on said surface so that said longitudinally extending parallel lines on said selarate elongated relatively thin, flat sheet are in alignment with said longitudinally extending parallel lines of said first elongated relatively thin, flat sheet.

2. A bowler's approach guide as in claim 1 and further comprising:

said elongated relatively thin, flat sheet having an upper surface and a lower surface; and said holding means being located on said lower surface and adapted to contact said surface.

3. A bowler's approach guide as in claim 2 and further comprising:

said elongated relatively thin, flat sheet having two lengthwise extending side edge portions, a front edge portion and a back edge portion; and said holding means extending at least between said front edge portion and said back edge portion and secured to said lower surface at locations adjacent to each of said side edge portions.

4. A bowler's approach guide as in claim 3 wherein:

said holding means comprises one-half of a hook and loop fastener; and said surface comprises a carpeted floor.

5. A bowler's approach guide as in claim 4 and further comprising:

a mirror positioned in front of and spaced a distance from said foul line and facing said bowler so that the movement of said bowler over said elongated relatively thin, flat sheet may be observed.

6. A bowler's approach guide as in claim 3 and further comprising:

said holding means also extending between said side edge portions and secured to said lower surface at locations adjacent to said front edge portion and at locations adjacent to said back edge portion.

7. A bowler's approach guide as in claim 3 wherein:

said surface comprises a relatively hard, non-flexible, flat surface.

8. A bowler's approach guide as in claim 7 wherein:

said holding means comprises one-half of a hook and loop fastener on said lower surface of said elongated relatively thin, flat sheet; and said holding means also includes the other one-half of the hook and loop fastener secured to said relatively hard, non-flexible, flat surface for mating engagement between each half of the hook and loop fastener.

9. A bowler's approach guide as in claim 1 wherein:

said elongated relatively thin, flat sheet is made from a flexible plastic material so that it may be folded and placed into a carrier to form a compact package so that it can be readily transported from one location to another distant location.

10. A bowler's approach guide as in claim 1 and further comprising:

indicating means for indicating when a bowler has violated said foul line.

11. A bowler's approach guide as in claim 10 and further comprising:

said elongated relatively thin, flat sheet having an upper surface and a lower surface; and said holding means being located on said lower surface and adapted to contact said any surface.

12. A bowler's approach guide as in claim 11 wherein said foul line comprises:

a raised element extending upwardly from said upper surface of said elongated relatively thin, flat sheet so that a bowler can feel the raised element if contact is made therewith.

13. A bowler's approach guide for use on any surface at any desired location for practicing a bowler's approach toward the foul line of a conventional bowling alley comprising:

an elongated relatively thin, flat sheet of material having a rectangular configuration corresponding to the standard approach area used at a conventional bowling alley;

said elongated thin, flat sheet having longitudinally extending parallel lines imprinted thereon to simulate the boards forming said standard approach area;

first and second lines of start position marks imprinted on said elongated relatively thin, flat sheet, each of said first and second lines comprising a plurality of spaced apart circular marks located at positions corresponding to similar circular marks used on said standard appraoch area;

a foul line indicator extending transversely across said elongated relatively thin, flat sheet to simulate the conventional foul line on said standard approach area;

holding means for holding said elongated relatively thin, flat sheet at a fixed position on said any surface so that a bowler may walk over said elongated relatively thin, flat surface and practice his or her bowling approach;

indicating means for indicating when a bowler has violated said foul line;

said elongated relatively thin, flat sheet having an upper surface and a lower surface;

said holding means being located on said lower surface nad adapted to contact said any surface; and said foul line comprises:

a portion of said elongated relatively thin, flat sheet folded back and secured to a surface of said elongated relatively thin, flat sheet so as to form an air pocket.

14. A bowler's approach guide as in claim 13 and further comprising:

a plurality of mechanical squeaking means mounted within said air pocket to generate and audible sound if said foul line is contacted by said bowler.

15. A bowler's approach guide as in claim 13 and further comprising:

a plurality of spaced apart electrical contact means mounted within said air pocket and connected to an electrical power source so as to generate an electrical signal if moved into contact with each other by said bowler.

16. A bowler's approach guide as in claim 13 wherein:

said portion of said elongated relatively thin, flat sheet is folded over and heat sealed to said upper surface of said elongated relatively thin, flat sheet.

* * * * *

UNITED STATES PATENT AND TRADEMARK OFFICE

CERTIFICATE OF CORRECTION

PATENT NO. : 4,773,644

DATED : September 27, 1988

INVENTOR(S) : Steven L. Lashman

It is certified that error appears in the above-identified patent and that said Letters Patent are hereby corrected as shown below:

In the Claims:

Column 4, line 35, "the foul line" should read --toward the foul line--.
Column 5, line 8, "selarate" should read --separate--.

Signed and Sealed this

Twenty-first Day of February, 1989

*Attest:*

DONALD J. QUIGG

*Attesting Officer*

*Commissioner of Patents and Trademarks*